US012709857B2

(12) United States Patent
Wojtaszek

(10) Patent No.: US 12,709,857 B2
(45) Date of Patent: Aug. 18, 2026

(54) FORCE COUPLE APPLICATION TOOL

(71) Applicant: Steven L Wojtaszek, Midland, MI (US)

(72) Inventor: Steven L Wojtaszek, Midland, MI (US)

( * ) Notice: Subject to any disclaimer, the term of this patent is extended or adjusted under 35 U.S.C. 154(b) by 183 days.

(21) Appl. No.: 18/422,083

(22) Filed: Jan. 25, 2024

(65) Prior Publication Data

US 2024/0254714 A1 Aug. 1, 2024

Related U.S. Application Data

(60) Provisional application No. 63/482,067, filed on Jan. 30, 2023.

(51) Int. Cl.

| | |
|---|---|
| ***E02D 7/22*** | (2006.01) |
| ***E02D 27/50*** | (2006.01) |
| ***E21B 7/00*** | (2006.01) |
| ***E21B 11/00*** | (2006.01) |

(52) U.S. Cl.

CPC ..... *E02D 7/22* (2013.01); *E02D 27/50* (2013.01); *E02D 2600/20* (2013.01); *E02D 2600/30* (2013.01)

(58) Field of Classification Search

CPC ..... E02D 7/22; E02D 27/50; E02D 2600/30; E21B 3/022; E21B 11/005

See application file for complete search history.

(56) References Cited

U.S. PATENT DOCUMENTS

| | | | | |
|---|---|---|---|---|
| 2,562,276 | A * | 7/1951 | Kandle | E21B 11/005 175/203 |
| 3,162,256 | A * | 12/1964 | Meinecke | E21B 11/005 175/252 |
| 3,177,736 | A * | 4/1965 | Kilmartin | E21B 11/005 408/124 |
| 4,116,284 | A * | 9/1978 | Cox | E21B 11/005 175/170 |
| 4,387,483 | A * | 6/1983 | Larrabee | E21B 11/005 175/170 |
| 5,007,492 | A * | 4/1991 | Giroux | E21B 15/006 175/203 |
| 2006/0251478 | A1* | 11/2006 | Desmeules | E02D 7/22 405/232 |

* cited by examiner

*Primary Examiner* — Amber R Anderson
*Assistant Examiner* — Stacy N Lawson

(57) ABSTRACT

A device enabling one person to apply torque in the form of a force couple to a product requiring torque to install or operate it. The reaction forces are directed into surrounding structure(s) to decrease or eliminate them from the operator via connected adjustable length flexible tension members mounted on ratcheting spools.

3 Claims, 2 Drawing Sheets

Force Couple Application Tool Basic Components

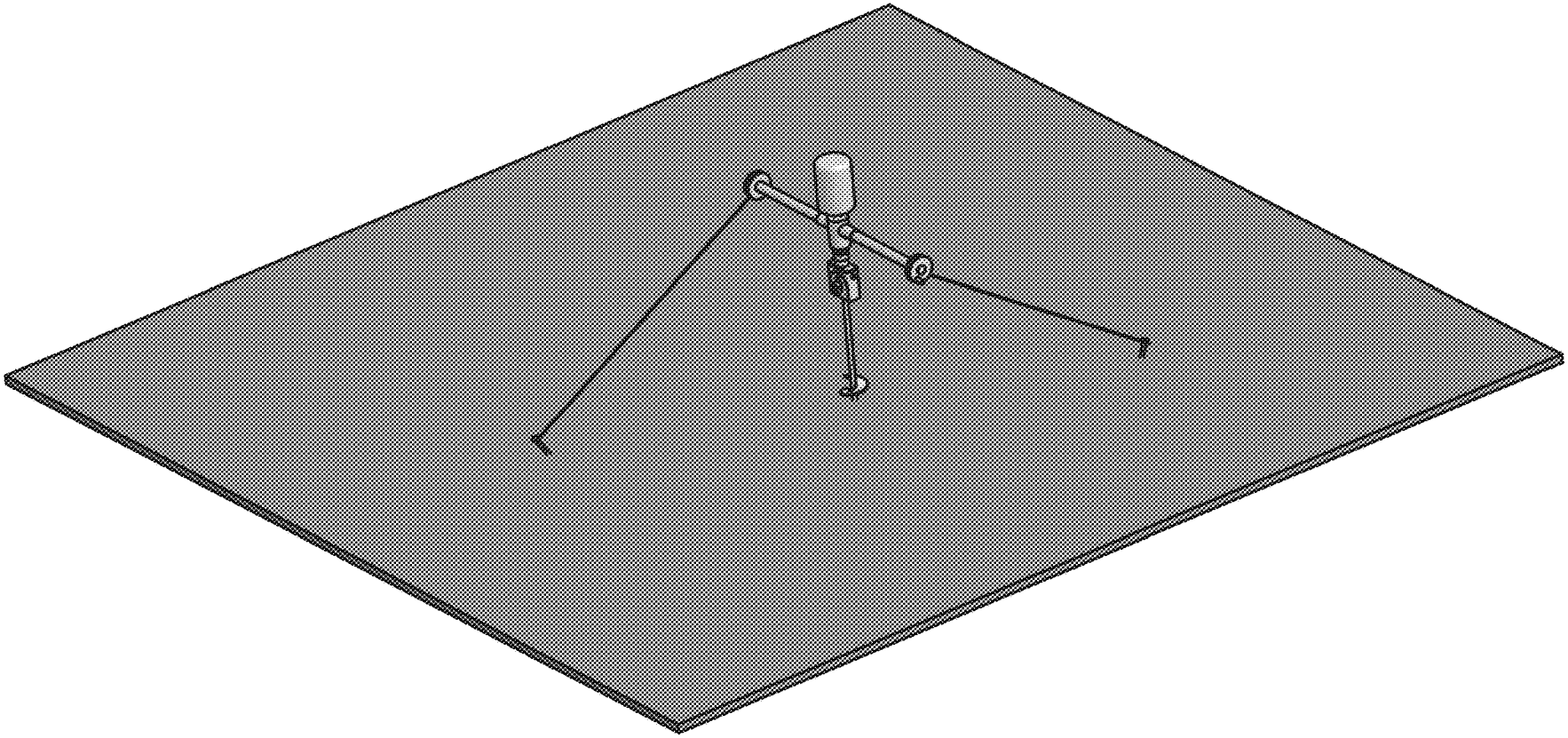
Fig. 1 Force Couple Application Tool as would be seen in typical use.
In this case for extraction of an earth anchor.

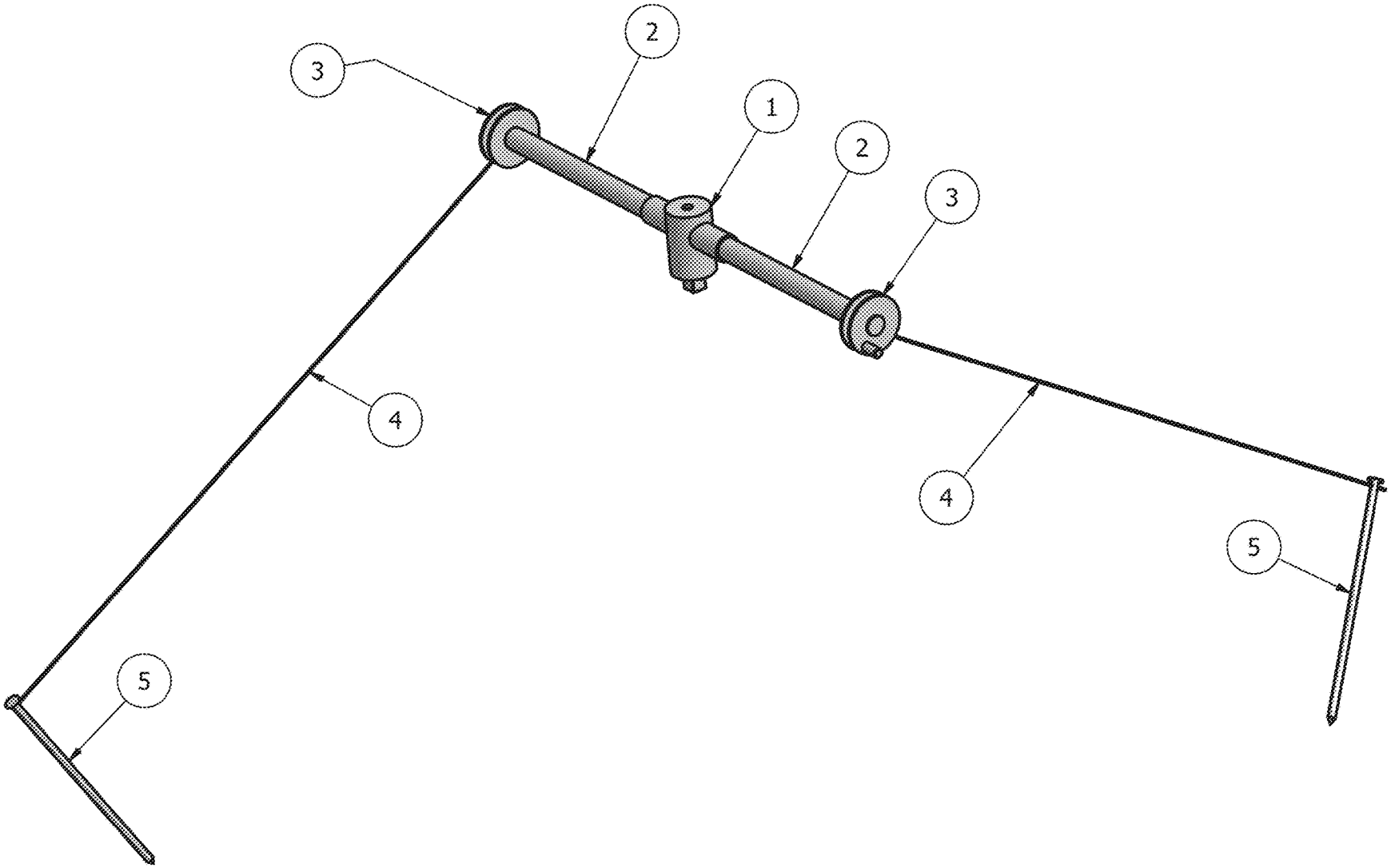
Fig. 2 Force Couple Application Tool Basic Components

FORCE COUPLE APPLICATION TOOL

BACKGROUND OF THE INVENTION

Instances where rotational energy in the form of torque over a displaced distance is required can be found in various applications. Common examples of these instances are drilling operations and installation of screw-type products (e.g. earth anchors, helical piers) into various types of mediums. Characteristics of the mediums and product designs dictate associated driving equipment which can range from hand powered levered bars, small electric powered household drills and impact drivers, to large tracked vehicles equipped with hydraulically powered capable of producing the torque required to achieve installation of a desired anchor. In order to apply torque, a means of counteracting the applied torque (also known as reaction- or counter-torque) must be available.

In the case of eye-type earth anchors, one of the simplest methods to install them is by placing a bar through the eye of the anchor which allows a person to provide torque manually to the anchor. The person's body becomes the means through which counteracting the torque occurs. As torque requirements increase, it becomes more difficult and can become a safety hazard to the person to counteract the torque. Additionally, while a couple (the same force in the same rotational direction on either side of the anchor eye) can be applied using this method, it is common for installers to apply the force on one side of the eye only, especially in a one-person configuration, to gain additional torque through a longer lever arm. This creates an additional bending force on the anchor which can cause the anchor to progress into the medium at an undesired angle and can increase frictional forces during installation requiring more torque than necessary to accomplish the installation.

In more elaborate methods, vehicles equipped with driving equipment which can achieve higher torque values are used. In many of these cases, these vehicles use structures which act along an arc in addition to not providing a couple which results in similar detrimental effects as in [002]

Impacting-type drivers have shown to be successful in driving screw products and have the inherent characteristic of a significant reduction in counter-torque forces to the operator and being compact in size. When compared to non-impacting drivers however, impact-type tend to be much less energy efficient with much of the energy creating heat and temperature rise which can lead to greatly accelerated wear and reduced life of components in the system. Impact-type drivers also have difficulty achieving their ultimate torque capability where the components collectively comprise a low rigidity system, i.e. a system which exhibits high flexure and absorbs the torsion impacts.

The objective of the Force Couple Application Tool is to allow one person (with the potential to perform the work autonomously) the ability to apply the required torque in the form of a force couple (which would ideally create a pure moment) to install products requiring torque values which would be objectionable and/or difficult to achieve by human force alone while removing some or all of the reaction forces from the operator by directing the forces to nearby objects capable of providing the reactionary forces.

Additionally, the tool inherently generates axial forces when torque is produced which can be used to an operator's advantage for installation and extraction of components where axial forces are beneficial. In the case of earth anchors, it is desirable to apply axial force to the anchor in the direction of anchor installation and extraction to facilitate progression of the anchor into and out of the earth.

Further benefits include being compact and lightweight enough to be transported in and out of a job site in a handheld case as opposed to a vehicle capable of achieving the same results. This is a much more cost effective system vs. vehicles or larger equipment and can result in a time and space savings to the work site and allow work to be done in tighter confines. These same attributes allow the system improved feasibility to be carried onboard a vehicle, ready for circumstances when anchors would be desired to be installed or removed.

SUMMARY OF THE INVENTION

In its very basic form, the Force Couple Application Tool is comprised of a prime mover capable of developing the required torque to accomplish the task, counter-torque arms allowing capability of creating a couple, flexible or rigid members providing tensile and/or compressive forces which are used to counter the forces in the arms and additionally provide axial forces to the anchor, and connections to anchor point(s) which support the flexible or rigid members.

In further developed forms, the Force Couple Application Tool can be comprised of a prime mover coupled to various types and configurations of torque increasers optimized for the conditions of the task, removable (for compactness and storage) torque arms, contain mechanisms for pre-loading the flexible or rigid members and balancing arm loading and aid in manipulation of the anchor installation angles and vertical forces, provided with connection points specific to a given application, and outfitted with provisions for remote starting and stopping of the rotation of the tool and to halt or disengage the primer mover automatically when a given depth of an anchor is achieved for reduced intervention and increased safety of the operator(s).

When configured with a flexible member such as a wire rope to support the torque arm to an anchor point, the system has the ability to conform to an installation or extraction path of a given anchor without developing the bending forces associated with using non-flexible members. This is helpful when anchor shafts are not straight but still need to be installed or removed. Flexible members supporting the torque arms also allow a more compact package as the members can be coiled up on spools vs. rigid members such as tubing which is not traditionally coiled. The disadvantage to this configuration is the system needs to be repositioned when being switched from installation to extraction of anchors and, without additional provisions, will only provide axial force in the installation direction even when removing anchors. This does not necessarily prevent removal of the anchor but works to impede it.

When configured with a rigid member such as a pipe or square tubing to support the torque arm to an anchor point, the system has the ability to provide the desired axial forces necessary to facilitate both installation and extraction without reconfiguration of the system. However, the disadvantage is the system will become less compact due to the rigid nature of the members even if they are able to be disassembled for storage and transport.

A primary objective of the anchor driver system is to reduce or eliminate the reaction torque to operator commonly found on handheld or hand operated devices in current use at the time of this document. As required torque values reach higher values this reaction torque can exceed a single person's ability to resist it, limiting the maximum amount of torque to the ability of the operator. The anchor driver system redirects the majority or all of the required counter-torque into another medium or structure. In the case of installing earth anchors, this could be the surrounding soil due to its proximity and convenience. Alternatively other fixed objects could be used such as trees, heavy objects, or other stationary items capable of withstanding the required forces.

Secondary benefits include the inherent ability to provide vertical (axial) forces to the anchors which can greatly improve both installation and extraction abilities for an anchor. Because the counter-torque component of the system uses members to attach the reaction arms to a fixed object such as the ground, and these attachment members can be at angles other than 90° during anchor installation and removal, vectors are created which can be broken into components: a horizontal force which is intended to provide the counter-torque, and a vertical force which, depending on the configuration, can be applied in both the down (install) and up (extract) directions.

The system can be driven by various prime movers creating rotational energy including a human supplying input torque. These include any device capable of producing power with common examples being internal combustion engines and electric and hydraulic motors.

The system can be equipped with a torque increasing mechanism which can balance operating speed and torque to optimize the capability of the prime mover with the installation requirements. This torque increasing mechanism can be a conventional or traditional mechanical gearbox but any device which increases torque can be used.

The system could be used both in an impacting and non-impacting fashion with appropriate provisions for each.

BRIEF DESCRIPTION OF THE DRAWINGS

FIG. 1 is an isometric overview of the assembled tool as it would be in operation;

FIG. 2 is a view of the components of the tool.

DETAILED DESCRIPTION OF THE PREFERRED EMBODIMENT

The preferred embodiment described herein represents a version of the inventors' device which contains the fundamental features but also features deemed desirable for convenient operation at the time of this submission. The "ideal" preferred embodiment is dependent on the application and requirements of the customer and may not include all of the items described in this example or may include items not included such as, but not limited to, wire rope clips, compression members, alternate connection designs, and a storage/transport case. Referring to the FIG. 2, the Force Couple Application Tool version shown includes a torque generator 1, reaction arms 2, tensioning devices 3, tension members 4, and ground attachment connections 5. The tensioning devices 3 are comprised of wire ropes (with anti-unspooling provisions when desired) spools, crank handles, and ratchet mechanisms.

The components are sourced as subassemblies (such as the prime movers, gearboxes, and ratchets) from suppliers of these products and the remainder of the components are fabricated from various grades and alloys of steel but any materials which meet the requirements could be used. Standard structural steel shapes such as pipe and plate are used in the construction and are cut to lengths suitable for and optimized for the targeted application. The components are assembled to produce the complete device. Components not intended to be removed or disassembled are welded together. Components which may need to be replaced or removed under certain circumstances are attached with retaining mechanisms which will allow servicing or replacement.

The invention claimed is:

1. A tool comprising:

a torque generator;

arms secured to and spaced approximately equally around said torque generator;

tensioning devices, each tensioning device secured to a distal end portion of a respective one of said arms; and flexible tension members capable of being coiled, each flexible tension member having a first end secured to a respective one of said tensioning devices, and a second end configured to be secured to a ground or object, wherein each of the tensioning devices is configured to adjust a tension force in the respective flexible tension member, and the tension forces produce a force couple that directs reaction forces caused by the torque generator to said ground or object.

2. The tool of claim 1 wherein each said tensioning device comprises a ratchet, spool, and crank handle.

3. The tool of claim 1 wherein each said tensioning device is configured to adjust the tension force in the respective flexible tension member to produce a vertical force acting on the respective arm.

* * * * *